US005554258A

United States Patent [19]

Suess et al.

[11] Patent Number: 5,554,258

[45] Date of Patent: Sep. 10, 1996

[54] FLOTATION PROCESS FOR MECHANICAL PULP USING A SURFACE ACTIVE AGENT

[75] Inventors: Hans U. Suess, Hasselroth; Norbert Nimmerfroh, Linsengericht; Ralf Grimmer, Rodenbach, all of Germany

[73] Assignee: Degussa Aktiengesellschaft, Frankfurt am Main, Germany

[21] Appl. No.: 238,746

[22] Filed: May 5, 1994

[30] Foreign Application Priority Data

May 26, 1993 [DE] Germany ..... 43 17 466.3

[51] Int. Cl.[6] ..... D21C 1/00; D21C 9/16

[52] U.S. Cl. ..... 162/24; 162/55; 162/74; 162/78

[58] Field of Search ..... 162/4, 5, 6, 78, 162/76, 24, 55, 72, 82, 74

[56] References Cited

U.S. PATENT DOCUMENTS

| | | | |
|---|---|---|---|
| 3,856,788 | 12/1974 | Corbett et al. | 260/244 R |
| 5,225,046 | 7/1993 | Borchardt et al. | 162/6 |
| 5,228,953 | 1/1993 | Bast et al. | 162/6 |
| 5,273,624 | 12/1993 | Chamberlain et al. | 162/4 |

OTHER PUBLICATIONS

Strunk, "Factors affecting hydrogen peroxide bleaching for high–brightness TMP", *Pulp & Paper*, Jun. 1980, 162–78.

Rydholm, *Pulping Processes*, Interscience Publishers, New York, Sep. 1967; p. 357.

*Primary Examiner*—Steven Alvo

*Attorney, Agent, or Firm*—Beveridge, DeGrandi, Weilacher & Young, L.L.P.

[57] ABSTRACT

An improved process for bleaching pulps is disclosed in which the unbleached pulp is subject to flotation before bleaching and, if necessary, the circulating water is also purified of interfering compounds by flotation.

6 Claims, No Drawings

FLOTATION PROCESS FOR MECHANICAL PULP USING A SURFACE ACTIVE AGENT

INTRODUCTION AND BACKGROUND

The present invention relates to an improved process for bleaching mechanical pulps, in which the unbleached pulp is subjected to flotation before bleaching.

The mechanical defiberization of wood produces high yields of pulps for paper production. The classical process is based upon an invention of the German scientist Keller in the first half of the 19th century. Debarked logs are pressed parallel to the fibre orientation against a rotating rough grindstone. This mechanically separates the fibers. The resulting "mechanical pulp" has approximately the brightness of the wood used initially and can be used for various kinds of paper.

The common term used in the industry is "groundwood" with the abbreviation "GW". Normally the timber is coniferous wood because of its longer and stronger fibers. Small-sized spruce timber from thinning work, with a trunk diameter of up to 15 cm, is the type most commonly used in Central Europe. Poplar is also occasionally used to produce mechanical pulps.

The classical groundwood pulp has been supplemented by a number of similar but differently produced wood pulps. The defiberization conditions are improved if the process is conducted at a higher pressure and a higher temperature level. At higher temperatures the lignin of the wood becomes softer and longer fibers with better strength properties are the result. The abbreviation used for this is "PGW" (pressurized groundwood).

Both processes produce coarse rejects as by-products (fiber bundles, slivers, shives) which have to be reground. Normally disk-refiners are used for the final defiberization process.

If logs are not available, saw mill waste can be chipped and the chips defiberized in refiners. This mechanical pulp is called "RMP" (refiner mechanical pulp).

Defiberization in refiners at a temperature of 120° C.–140° C. yields very good strength properties. The temperature treatment softens the lignin. The mechanical process at the edges of the refiner disks results in a very high amount of long fibers and a relatively low short fiber fraction. These wood pulps are called "TMP" (thermo mechanical pulp). The strength properties of a TMP are significantly superior to those of a standard groundwood. The higher temperatures of the defiberization conditions cause a darkening of the resulting pulp.

Prior to thermo mechanical defiberization, a chemical pretreatment of the wood chips is possible. A wide variety of different mechanical pulps are the result. The addition of sodium sulfite and caustic soda chemically modifies the wood and facilitates the defiberization process. Depending on the amount of chemicals, the treatment temperature and the intensity of the treatment with chemicals, wood pulps with very different properties and yields are obtained. These pulps are labeled with abbreviations such as "CTMP" (chemo thermo mechanical pulp) and "CMP" (chemo mechanical pulp).

Very high temperatures are commonly used now in producing wood pulp. Disintegration of wood to produce groundwood (GW) is done at temperature above 90° C. Pressurized groundwood (PGW) is produced at circulation temperatures near the boiling point. The temperature level is even higher in production of thermomechanical pulp (TMP) or CTMP (chemo-thermomechanical pulp), which is chemically pretreated TMP. The temperature in the refiner is usually above 130° C.

This temperature stress causes hydrolysis of some components of the wood, causing the wastewater to be heavily loaded with dissolved and colloidal compounds. It reaches a specific value of about 30 kg chemical oxygen demand per ton for groundwood, and up to more than 40 kg/ton for TMP. As the water loop is partially tightly closed, the loading in the circulating liquid is generally very high.

Low-molecular-weight compounds such as organic acids (e.g., acetic acid), sugar, short-chain hemicelluloses (e.g., arabinose), lignines (e.g., hydroxymatairesinol) and rosins (e.g., abietic acid) appear in the circulating water in dissolved or colloidal form. These are matters well known in the art.

In bleaching of wood pulps, the loading of the circulating water with these materials causes a serious deterioration of brightness and increases the need for chemicals. Washing the pulp is one possibility for improving the increase in brightness and decreasing the need for chemicals. That is done in many TMP plants, by diluting with large quantities of fresh water after the disintegration process and pressing it out again. The wastewater is not returned to the circulation, but goes directly to the wastewater treatment plant. Of course, that process uses a large amount of water. In many countries, though, fresh water is not available in unlimited amounts. Limits to the total chemical oxygen demand (COD) also reduce the possibility for wastewater cleanup by very high dilution. The difficulty of removing water from the pulp is a further problem. While chemical pulp can be dewatered and washed using relatively little water, by means of an appropriate complex technical system, such as pressure washing, that does not apply to the far more slimey mechanical wood pulp.

Wood pulp with a degree of beating of 70 to 80 Schopper-Riegler cannot practically be cleaned by diffusion washing. An effective washing process would require dilution and thickening and would be linked with a correspondingly high specific water consumption.

In the paper industry, the circulating water is cleaned by various mechanical and chemical-mechanical processes. While colloidal material can be removed only to a limited extent by filtration and sedimentation, it can be removed by total flotation using extremely long-chain polymers such as polyacrylamides as flocculating agents. These processes give nearly quantitative flocculation. The flocculated particles are separated from the circulating water by this total flotation and disposed of as sludge. The capital and operating costs of this circulating water cleanup process are a disadvantage, as is the complete loss of all the fibers in the circulation. Thus, an additional precleaning of the circulating water by a rotary disk filter is required if one wants to prevent fiber losses. This, again, makes the cleanup so expensive that usually only the main loop is subjected to such a process. Basically, though, it would be reasonable to do this cleanup step repeatedly so as to provide optimal conditions for the process steps and to reduce their chemical usage.

Accordingly, the industry has sought a process that reduces the need for bleach chemicals and may also improve the increase in brightness.

SUMMARY OF THE INVENTION

An object of the present invention is to improve the process for bleaching wood pulp, wherein the unbleached wood pulp is first subjected to a flotation treatment using a cationic tenside under weakly acidic conditions (pH range 4 to 7, preferably 5.5 to <7). The floated contaminants are separated, and the remaining wood pulp can then be subjected to a bleaching sequence, of any suitable type, preferably using $H_2O_2$ at any convenient time. The tensides, also called surface active agents, used to assist flotation are, in particular, compounds of the general formula $$CH_3(CH_2)_n-N^+(CH_2-R)_3X$$

in which n is 10 to 18, especially 14 to 18,

R is H or $CH_3$,

X is Cl, Br or I, which are used in a proportion of 0.01 to 1% by weight, based on the wood pulp (absolutely dry weight).

DETAILED DESCRIPTION OF INVENTION

Froth flotation is known in the field of mineral recovering and is a process for separating finely ground valuable mineral from their associated gangue. The process is based on the affinity of properly prepared surfaces for air bubbles. A froth is formed by introducing air into a pulp of finely divided solid material such as ore in water containing a frothing or foaming agent. Minerals with a specific affinity for air bubbles rise to the surface in the froth and are thus separated from those wetted by water. In preparation, the ore must first be ground to liberate the intergrown valuable mineral constituent from its worthless gangue matrix. The size reduction, usually to about 208 μm (65 mesh), reduces the minerals to such a particle size that they may be easily levitated by the bubbles. These principles are well known.

Froth flotation is usually used to separate one solid from another, for solid-liquid separations, as in dissolved air flotation, and for liquid-liquid separations, as in foam fractionation. The process also has the potential to make a particle size separation since fine particles are more readily flocculated and floated than are coarse ones.

Froth flotation is the principal means of concentrating copper, lead, molybdenum, zinc, phosphate, and potash ores, and a host of others. In the United States, nearly 400 million metric tons of ore are treated per year by this unit operation. Its chief advantage is that it is a relatively efficient operation at a substantially lower cost than many other separation processes. Separations by flotation also include widely divergent applications such as the separation of ink from repulped paper stock, peas from pea pods, oils from industrial wastes, and metal ions, bacteria, proteins, and colloidal particles from water. Flotation is described in detail in Kirk-Othmer, Encyclopedia of Chemical Technology, 3rd Edition, Vol. 10, p. 523 et seq.

Flotation, which has not previously been known in the field of pretreatment of wood pulp, can be carried out in a wide range of temperature, for example 20° to 90° C., especially 40° to 70° C. The consistency of the pulp to be subjected to flotation varies between 0.5% and 2% by weight, based on the total amount.

The pulps which can be treated include, for example, groundwood, pressurized groundwood, TMP and CTMP, especially from spruce and pine. The requirement for hydrogen peroxide to reach a specific brightness is distinctly reduced in connection with the flotation according to the invention. At the same time it becomes possible to reduce the amount of water glass (sodium silicate solution) otherwise usual for buffering and stabilizing the bleach. This proves particularly attractive in practice, as large quantities of silica produce anionic colloidal silicic acid sols, distorting the cationic retention processes.

Usually water glass quantities of ~3% by weight, based on the absolutely dry pulp, are used. These quantities can now be reduced to ≦ 2% by weight.

In another embodiment of the process, not only all the pulp, but also circulating water containing fines, having a pulp concentration of 0.05 to 0.5% by weight, especially 0.1 to 0.3% by weight, based on the total volume of circulating water, is treated by flotation.

That makes it possible to avoid the disturbance of the primary flotation process, consisting of floating fibers hindering the rise of air bubbles, and so gaining a great effect with considerably lower mechanical expenditure.

The process according to the invention leads to a distinct improvement of the bleachability of pulp. Among the contaminants that interfere with bleaching is, for example, rosin. As shown by the alteration in the dichloromethane extract, the flotation process distinctly reduces the interfering materials. Comparison experiments show that it is not enough to use only dispersing agents in the flotation. Presence of a cationic surface active agent and maintenance of the specified pH range are important for successful operation.

The related bleaching is done later according to the state of the technology. The pulp may if necessary be treated with a complexing agent prior to bleaching.

The complexing agent may be DTPA, or it may be zeolites combined with an easily degradable complexing agent (see European Patent Application 0518036). These are well known in the art.

Pulps vary considerably in their color after pulping, depending on the wood species, method of processing, and extraneous components. For many paper types, particularly printing grades, bleaching of the raw pulp is required. The brightness standard is measured as the reflectance of light in the blue range (457 nm) compared with magnesium oxide as 100% white. Two scales are used, depending on the commercial meter. In the United States, the General Electric meter is the standard. In other countries, the Zeiss Elrepho is standard. In general, the GE brightness is 0.5–1% lower than the Elrepho value.

There are basically two types of bleaching operations: those that chemically modify the chromophoric groups by oxidation or reduction but remove very little lignin or other substances from the fibers, and those that complete the delignification and remove pitch and some carbohydrate material. In the special case of dissolving-pulp production, bleaching is a final purification of cellulose, and most of the residual hemicellulose is removed.

The lignin-retaining type of bleaching is used with high yield mechanical and chemimechanical pulps in paper grades. e.g.. newsprint, where brightness stability is not critical. The initial brightness values of these pulps usually are 50–65% GE. If sodium bisulfite is added in a chemimechanical process, the pulps are a few points brighter.

The most effective bleaching agent for mechanical pulps is hydrogen peroxide. Bleaching is performed in alkaline solutions. Sodium silicate and magnesium sulfate usually are added to buffer the solutions and to sequester metal ions, which would otherwise wastefully accelerate the decomposition of the peroxide. The pH should be 10.5–11 and the consistency as high as possible. Typically the consistency is between 12% and 30%. The reaction requires typically 3 h at 50° C. and is followed by a neutralization and destruction of excess peroxide with $SO_2$. Conditions can vary.

Brightness of high yield pulps can also be achieved reductively with sodium hydrosulfite. Bleaching is performed with 0.5–1 wt % hydrosulfite for 2 hours at 55° C.

The following examples serve to illustrate the details of the invention.

EXAMPLE 1

Bleaching a TMP Derived From Spruce (conventional process)

1.1 Without flotation of the pulp Original brightness 52.8% ISO Bleach at 20% consistency, 70° C. residence time 4 hours. Pretreated with 0.5% DTPA in the water circulation for pulp production. Bleach with:

2% $H_2O_2$ 1.4% NaOH 3.0% Water glass (Sodium Silicate)

Under the given limiting conditions, the proportion of the $H_2O_2$ used decreases to 0.11%, based on the fiber material. The brightness rises to 65.5% ISO.

1.2 With flotation of the pulp The pulp is first subjected before bleaching to flotation at 1% consistency, using circulating water at pH 6.0 to 6.1, for 10 minutes at 40° C. 0.25% hexadecyl-trimethylammonium bromide is added for flotation. The yield from flotation is 99.1%. Then the pulp is thickened and bleaching is done under conditions identical to those for Example 1. The residual peroxide content after bleaching is 0.18% $H_2O_2$, with brightness of 66.8% ISO.

The residual peroxide content can be used advantageously as a biocide in the paper machine with water.

1.3 Flotation of the circulating water, The pulp, at 5% consistency, is first thickened to 25% consistency and the water removed is subjected to flotation at pH 6.5 and 40% C. The water purified in this manner is reused to dilute the pulp. Then it is thickened again, and the bleaching is done with identical chemical usage as in Examples 1.1 and 1.2. The resulting residual peroxide content is 0.18% $H_2O_2$, based on the pulp, and a brightness of 67.3% ISO.

As comparison of the examples shows, a clearly measurable gain in brightness is produced by the pretreatment.

The flotation yield and the degree of removal of rosin from the pulp are clearly influenced by variation of the amount of the quaternary ammonium salt used between 0.1% and 1% (based on absolutely dry pulp).

EXAMPLE 2

The example shows the removal of extract substances by flotation, depending on the amount of hexadecyl-trimethylammonium bromide used. The extract content of the raw material was 0.47% (TMP from spruce).

TABLE 1

| Experiment | Amount of hexadecyltri-methylammonium bromide added % | Yield % | Dichloromethane extract in floated and bleached pulp % |
|---|---|---|---|
| 1 | 0.1 | 99.7 | 0.37 |
| 2 | 0.25 | 99.4 | 0.17 |
| 3 | 0.5 | 98.3 | 0.15 |
| 4 | 1.0 | 97.2 | 0.12 |

Essentially, the decrease in the dichloromethane extract indicates a reduction of the rosin content in the pulp. The dispersing properties of resins cause problems with retention. They can hinder sizing of the paper and can provoke deposits in the pipeline system and on the paper machine. From the viewpoint of the paper maker, therefore, the lowest possible resin content (i.e., extract content) is desired. Because the sticky rosin can collect dirt particles, the rosin content also has bad effects on the brightness.

EXAMPLE 3

This example shows the potential deduction in the amounts of chemicals used by a previous flotation. The bleaching was done throughout at 70° C., 20% consistency, and with 4 hours residence time. In these cases, also, the pulp (TMP from spruce) was pretreated in the low consistency range with 0.25% DTPA. The flotation was done at 1% consistency and 40° C. at pH 6.5 to 6.8. 0.25% hexadecyl-trimethylammonium bromide was used.

TABLE 2

| Experiment | $H_2O_2$ | NaOH % | Water glass | Residual $H_2O_2$ % | Brightness % ISO |
|---|---|---|---|---|---|
| 1 without flotation | 3 | 1.8 | 3.0 | 0.26 | 69.4 |
| 2 with flotation | 3 | 1.8 | 3.0 | 0.38 | 70.6 |
| 3 with flotation | 3 | 1.7 | 2.0 | 0.33 | 70.1 |
| 4 with flotation | 2.5 | 1.5 | 2.0 | 0.18 | 69.4 |

The examples clearly show that removal of interfering compounds in the flotation considerably reduces the amount of water glass needed to stabilize the bleach. Consistent optimization of the amount of $H_2O_2$ makes it possible to get the identical brightness as from a conventional bleach while simultaneously saving both $H_2O_2$ and sodium hydroxide. The reduction of the amount of water glass used leads to reduction of the need for retention agent in the paper machine. Thus flotation of the pulp or of the circulating water saves substantially on costs.

Further variations and modifications will be apparent to those skilled in the art from the foregoing and are intended to be encompassed by the claims amended hereto.

German priority application P43 17 466.3 is relied on and incorporated herein by reference.

What is claimed:

1. A process for pretreating unbleached mechanical pulp, having a degree of beating of 70 to 80 Schopper-Reigler, obtained from the defiberization of wood prior to paper production and which pulp is subsequently bleached and made into paper, comprising subjecting said unbleached mechanical pulp obtained from wood to flotation in a flotation zone at a pH between 4 and < 7 using 0.01% to 1% by weight, based on the absolutely dry pulp, of a cationic surface active agent, removing the resulting froth containing organic acids, sugars, short-chain hemicelluloses, lignins and rosins in dissolved or colloidal form resulting from the defiberization of wood from the flotation zone and obtaining the pre-treated wood pulp.

2. The process according to claim 1, wherein said surface active agent is a compound of the formula $$CH_3(CH_2)_n-N^+(CH_2-R)_3X \quad (I)$$

in which:

n is 10 to 18,

R is H or $CH_3$,

X is Cl, Br or I.

3. The process according to claim 1, wherein the wood pulp is treated before bleaching with a complexing agent.

4. The process according to claim 1 further comprising treating said pre-treated wood pulp by bleaching with $H_2O_2$.

5. The process according to claim 4, wherein water glass is present in the bleaching step up to or less than 2%.

6. The process according to claim 1, wherein circulating water is also freed from finely particulate unbleached wood pulp in it by flotation of the interfering materials.

* * * * *